US011358686B2

(12) United States Patent
Ely

(10) Patent No.: US 11,358,686 B2
(45) Date of Patent: Jun. 14, 2022

(54) RIGHTING DEVICES FOR ASSISTING WITH RIGHTING CAPSIZED WATERCRAFT, AND WATERCRAFT INCORPORATING SUCH RIGHTING DEVICES

(71) Applicant: Benjamin Ely, Grantham, NH (US)

(72) Inventor: Benjamin Ely, Grantham, NH (US)

( * ) Notice: Subject to any disclaimer, the term of this patent is extended or adjusted under 35 U.S.C. 154(b) by 22 days.

(21) Appl. No.: 16/947,870

(22) Filed: Aug. 21, 2020

(65) Prior Publication Data

US 2021/0053659 A1 Feb. 25, 2021

Related U.S. Application Data

(60) Provisional application No. 62/890,307, filed on Aug. 22, 2019.

(51) Int. Cl.
*B63B 43/00* (2006.01)

(52) U.S. Cl.
CPC ..... *B63B 43/00* (2013.01)

(58) Field of Classification Search
CPC ..... B63B 43/00; B63C 7/003
See application file for complete search history.

(56) References Cited

U.S. PATENT DOCUMENTS 4,003,099 A 1/1977 Hivko
6,247,981 B1 * 6/2001 Farley ..... B63H 1/04 114/123
2006/0096518 A1 5/2006 Hulbert

FOREIGN PATENT DOCUMENTS

FR 2518955 A1 7/1983
WO 1991001914 A1 2/1991

* cited by examiner

*Primary Examiner* — Andrew Polay
(74) *Attorney, Agent, or Firm* — Downs Rachlin Martin PLLC

(57) ABSTRACT

Righting devices that provide foot and/or hand holds to allow users to manually right capsized watercraft. In some embodiments, each righting device is configured to be secured to a hull bottom so as to extend outwardly from the surface of the hull bottom. In some embodiments, each righting device includes at least one receptacle that is recessed relative to a hull bottom. Righting devices of the present disclosure may, for example, be retrofitted to existing hull bottoms. Righting devices of the present disclosure may be formed monolithically and integrally with hull bottoms during construction thereof. The present disclosure is also directed to methods of using righting devices of the present disclosure, as well as to kits that include one or more righting devices, installation instructions for locating and installing one or more righting devices, and/or use instructions describing how to use the righting device(s) to right a capsized watercraft.

21 Claims, 6 Drawing Sheets

RIGHTING DEVICES FOR ASSISTING WITH RIGHTING CAPSIZED WATERCRAFT, AND WATERCRAFT INCORPORATING SUCH RIGHTING DEVICES

RELATED APPLICATION DATA

This application claims the benefit of priority of U.S. Provisional Patent Application Ser. No. 62/890,307, filed Aug. 22, 2019, and titled "FOOTHOLDS FOR RIGHTING CAPSIZED BOATS, AND BOATS HAVING SUCH FOOTHOLDS", which is incorporated by reference herein in its entirety.

FIELD OF THE INVENTION

The present invention generally relates to the field of small watercraft. In particular, the present invention is directed to righting devices for assisting with righting capsized watercraft, and watercraft incorporating such righting devices.

BACKGROUND

Small watercraft can capsize and cause challenges to the occupants of the watercraft in righting the watercraft. For example, sailing dinghies often used for training young sailors are relatively easily upset and capsized during training and routine use. Often young sailors are not fully grown, and their lack of size and strength relative to adult sailors can make righting a capsized dinghy especially challenging.

SUMMARY OF THE DISCLOSURE

In one implementation, the present disclosure is directed to a kit for assisting a user in righting a watercraft when the watercraft is capsized, the watercraft including a hull bottom. The kit includes a righting device that includes a base designed and configured to confront the hull bottom; a fastening system for securing the righting device to the hull bottom; and at least one foot/hand hold fixedly secured to the base, the at least one foot/hand hold spaced from the hull bottom so as to allow the user to grasp the at least one foot/hand hold when the watercraft is capsized; and installation instructions for instructing an installer on installing the righting device on the hull bottom, the installation instructions including instructions for locating the righting device on the hull bottom so as to allow a user to stand on the at least one foot/hand hold to aid in righting the watercraft; and instructions for deploying the fastening system to secure the righting device to the hull bottom.

In another implementation, the present disclosure is directed to a righting device for assisting a user with righting a watercraft when the watercraft is capsized, the watercraft having a hull bottom. The righting device includes a base designed and configured to be secured to the hull bottom; a fastening system to secure the righting device to the hull bottom; and at least one foot/hand hold rigidly secured to the base so as to be spaced from the hull bottom when the righting device is secured to the hull bottom, the at least one foot/hand hold including a step region having one or more anti-slip features to inhibit slipping when the user is engaging the step region to right the watercraft when capsized.

In yet another implementation, the present disclosure is directed to a watercraft that includes a hull having a bottom and a longitudinal centerline; and a first righting device located on the bottom of the hull in a first location laterally offset relative to the longitudinal centerline.

BRIEF DESCRIPTION OF THE DRAWINGS

For the purpose of illustration, the drawings show aspects of one or more embodiments of this disclosure. However, it should be understood that the present disclosure is not limited to the precise arrangements and instrumentalities shown in the drawings, wherein.

DETAILED DESCRIPTION

Figure 1:
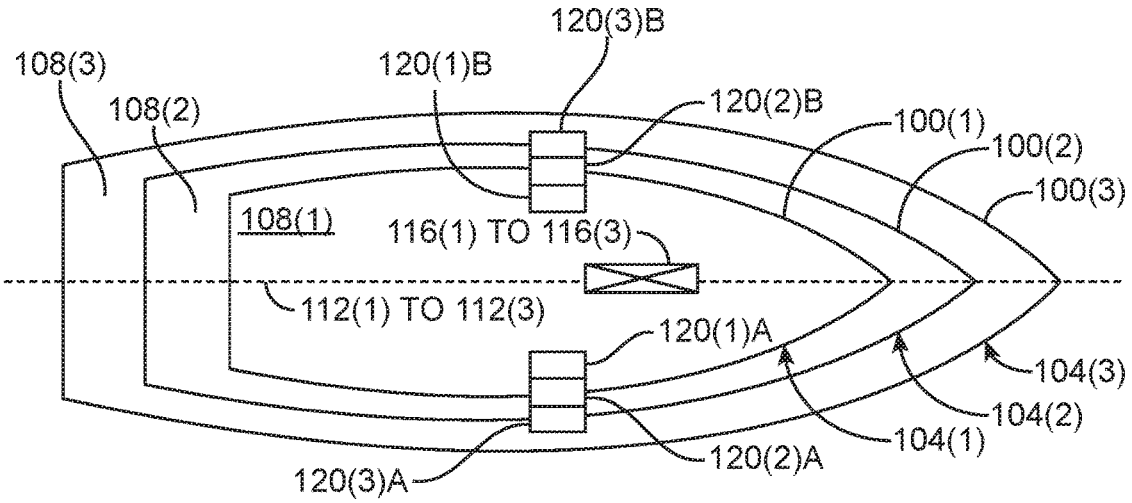
FIG. 1 is a reverse plan view of the exteriors of three hull bottoms of sailing dinghies of differing sizes, illustrating example locations for righting devices made in accordance with the present disclosure.

In some embodiments, the present disclosure is directed to righting devices for providing to hull bottoms of watercraft to assist users in righting the watercraft when capsized. Examples of watercraft that can benefit from righting devices made in accordance with the present disclosure include, but are not limited to, small boats, such as sailing dinghies, row boats, motorboats, small paddleboats, and personal watercraft, among others. Typically, though not necessarily, watercraft suitable for receiving or otherwise including one or more righting devices of the present disclosure are mono-hull watercraft, though in some cases a suitable watercraft may be, for example, bi-hulled or tri-hulled. At a high level, a righting device of the present disclosure provides a foot and/or a hand hold that allows a user to stand on the righting device during use and/or grasp the righting device during use. The term "foot/hand hold" is used herein and in the appended claims to denote this functionality.

In some instantiations, a righting device of the present disclosure may be provided to aid a novice sailor in righting a capsized sailboat quickly and with less effort and difficulty compared to conventional righting techniques. In some instantiations, a pair of righting devices may be mounted in two locations on the hull of a small sailboat, like the sailing dinghies seen at: https://www.boats.com/boat-buyers-guide/ best-beginner-sailing-dinghies. The content of the webpage accessible by the foregoing URL is incorporated herein by reference.

If the sailboat capsizes on its side, a user may put their foot/feet on one of the two righting devices and grab the edge (i.e., the gunwale) of the boat. Then the user may lean back to use their weight to right the sailboat. With the righting devices available, there may be no more slippery surfaces (e.g., such as on a centerboard) to be afraid of or hyperthermia risk from an extended stay in the cold water.

In some instantiations, a righting device of the present disclosure is a device designed and configured to be removably secured to a hull bottom of a watercraft without requiring any fasteners or other securing structure(s) that break the outside surface of the hull bottom. In this manner, such a righting device can be used temporarily as desired. In this connection, a righting device of the present disclosure may include a fastening system that provides this temporary securement, including, but not limited to, one or more adhesives and/or one or more suction cups. An example of when it may be desirable to have a righting device of the present disclosure be removable is providing the righting device to a sailing dinghy being used to train young sailors that may not be fully grown and not have the strength to right the sailing dinghy using conventional techniques that use only the sailing dinghy's centerboard. In this example, the righting device may be temporarily installed for a single sailing session, multiple sailing sessions, or some period of time, such as a week, a month, a sailing season, etc. As another example, a removably securable version of a righting device of the present disclosure may be installed at the time of the capsizing, if desired.

In some instantiations, a righting device of the present disclosure may be designed and configured to be retrofitted to an existing watercraft in a more permanent matter. In this case, the righting device may include a fastening system that includes mechanical fasteners and/or one or more structures (e.g., tabs) that penetrate the hull bottom and are intended to provide a more permanent installation. Such mechanical fasteners and/or structures may be complimented by the use of an adhesive and/or a sealing gasket, among other things. Examples of mechanical fasteners that can be used include, but are not limited to screws, bolts, and rivets, among others.

In some instantiations, a righting device of the present disclosure may be designed and configured to be integrated into a new hull during construction; for example, a righting device similar to a removably securable righting device as described above. In this case, the righting device is completely or mostly external to the hull bottom and is outstanding from the hull bottom so as to provide the necessary foot/hand-hold functionality. In some instantiations, such an outstanding, but integrated, righting device may be molded into the hull bottom or at least partially constructed separately from the hull and integrated into the hull, for example, when laying up the hull, which may be made of fiberglass as is well known in the art.

As another example, a righting device of the present disclosure may be integrated into a hull so as to be recessed in the hull. For example, the righting device may be provided as a recessed foot/hand hold receptable. In some instantiations, such a recessed righting device may be molded into the hull bottom or at least partially constructed separately from the hull and integrated into the hull, for example, when laying up the hull, which may be made of fiberglass as is well known in the art. As another example, a recessed foot/hand hold version of a righting device of the present disclosure may be retrofitted to the hull of an existing watercraft. For example, a preformed foot/hand hold receptacle may be provided, and a corresponding opening can be made in the hull at the appropriate location. The preformed foot/hand hold receptacle can then be secured to the hull, and the hull be made watertight in any suitable manner(s). The preformed recessed foot/hand hold receptacle may include any needed additional structure(s) (not shown), such as flanges, grooves, etc., needed to suit a particular retrofit installation.

A recessed foot/hand hold receptacle of the present disclosure may include one or more handgrips. In one example, a single handgrip may be centered in the opening of the foot/hand hold receptacle. This handgrip may also function as a foothold. Alternatively, the longitudinal (relative to the centerline of the hull) sides of the foot/hand hold receptacle may function as footholds. Like other handgrips disclosed herein, this handgrip may include one or more grip-enhancement features, such as ergonomic contouring, and/or one or more anti-slip features, such as knurling and/or higher friction materials. In other embodiments, this handgrip need not be present. In some embodiments not including a handgrip spaced from the longitudinal sides of the recessed receptacle, handgrips may be provided on both longitudinal sides, for example, by integrating a curved gripping region into each longitudinal side, among other possibilities.

In some embodiments, the recessed foot/hand hold receptacle may be left open, whereas in other embodiments, it may be provided with a removable closure that may be largely flush with the exterior surface of the surrounding hull bottom when installed. In this manner, the hull bottom may remain streamlined. The removable closure may include one or more features for assisting a user in removing the closure, such as a fingerhole, knob, or tab, among others. The removable closure may be designed and configured to float so as to assist in its retrieval.

In some embodiments, the removable closure may be secured in its closing position using one or more quick-opening features, such as a friction fit, a sliding latch, spring biasing, etc. In other embodiments, the removable closure may be secured in its closed position using one or more other features, such as threaded fasteners. For example, if the removable closure is to be removed only for certain uses of the watercraft, quick-opening, and perhaps more secure features may be desirable. For example, if it is necessary to have the removable closure removed for only certain events, such as training a young sailor, but desirable to have the removable closure in place at all other times, such as when racing or when a more experienced sailor will right the watercraft when capsized, then screws or other highly securing features may be more desirable.

In some embodiments, the removable closure may be tethered to the watercraft using suitable tethers, such as a section of nylon line, a plastic strip, or a hinge, among others, to ensure that the removable closure remains with the watercraft. In some embodiments, the removable closure, especially when tethered, may remain covering the recessed foot/hand hold receptacle except during a capsizing event, when the user can remove it before using the recessed foot/hand hold receptacle to assist in righting the capsized watercraft.

In some embodiments, a righting device of the present disclosure may include one or more anti-slip features for inhibiting slipping of a user's foot or feet and/or assisting with effecting a more-positive hand grip. Example anti-slip features are identified below. In some embodiments, a righting device of the present disclosure may include a handgrip that allows a user to grasp onto the righting device.

Such handgrip may be specially designed to afford the user greater gripping ability, such as by providing a gripping member shaped (e.g., have protrusions, form a bulbous shape, etc.) to specifically accommodate firm gripping of a human hand. A handgrip may be unitary and monolithic with a righting device or it may be formed separately and attached to the righting device.

In some embodiments, the present disclosure is directed to kits that each include at least one righting device of the present disclosure along with installation instructions for instructing an installer on installing the righting device(s) to a watercraft and/or use instructions for instructing a user on using the righting device(s) to right a capsized watercraft. In some embodiments, the installation instructions and/or the use instruction may be provided in any suitable form, such as written form, graphical form, video form, or any combination thereof. It is noted that while the term "kit" is used, it should not be construed to denote that the components of the kit be located in close physical proximity with one another, such as within and/or on common packaging. While this can indeed be the case for instances in which the righting device(s) and the installation instructions and/or use instructions are provided together in a common package, it is not mandatory. For example, a kit of the present disclosure may include one or more righting devices and an instruction accompanying the righting device(s) to visit a website to view or otherwise obtain the installation and/or use instructions. In this case, the remotely obtained installation and/or use instructions are considered to be part of the kit, even though they were not in close physical proximity to the righting device(s) to which they pertain. Generally, the existence of a kit is more broadly defined in terms of functional relationship between the righting device(s) and the installation and/or use instructions.

Installation instructions may vary according to the form of the righting device(s) and the manner in which each righting device is provided to a watercraft. For example, if the righting device(s) in the kit is/are of the removably installed type, then the instructions will include instructions for locating each righting device on a watercraft hull bottom and/or removably securing each righting device to the hull bottom. As discussed below in more detail, in some embodiments each righting device is located in a location laterally (relative to a longitudinal centerline of the hull) offset from the longitudinal centerline of the hull. In some embodiments, the kit includes two or more righting devices, and the installation instruction includes instructions for locating two of the righting devices on opposite sides of the longitudinal centerline. Also as discussed below, in some embodiments, the installation instructions include instructions for locating at least one righting device in a direction parallel to the longitudinal centerline. In a particular embodiment, useful, for example, for sailing dinghies and/or other watercraft having a centerboard, the installation instructions include instructions for locating at least one righting device aftward of the centerboard and/or so that a user can grasp and/or stand on the centerboard during a righting maneuver using the righting device(s). More specific examples are described below.

If the righting device(s) in a kit is/are of the permanently installed type, then the installation instructions will include instructions for locating each righting device on a watercraft hull bottom and/or securing each righting device to the hull bottom or integrating each righting device into the hull bottom. Regarding the locating of each righting device, the instructions for such locating may be the same as or similar to the instructions discussed above and/or elsewhere in this disclosure. In some instantiations, each righting device may be a completely or largely external device having most or all of its parts located exteriorly of the hull bottom. In these instantiations, the installation instructions may include corresponding respective securing and/or integration instructions. For example, in some instantiations, each righting device may be surface mounted to the exterior of the hull bottom, whereas in some instantiations each righting device may need to be integrated into the hull bottom, for example, by integral molding, mounting in an opening formed in the hull bottom, etc., and the corresponding installation instructions may include explicit instructions on how to effect such securing and/or integration. As another example, each righting device may be a completely or largely recessed foot/hand hold device. In some instantiations, each recessed foot/hand hold device may be configured to be retrofitted into an existing watercraft hull bottom, whereas in other instantiations each recessed foot/hand hold device may be configured to be integrated into a new hull bottom during constructions of the hull bottom, and the corresponding installation instructions may include explicit instructions on how to effect such retrofit or new installation. Those skilled in the art will readily understand how to prepare such instructions for any specific scenario that may be at issue.

Use instructions, if provided, may include specific instructions on how to use the one or more righting devices installed on a particular watercraft to right the watercraft when capsized. Depending on the watercraft at issue, the use instructions may include steps specific to one or more features of a particular watercraft. For example, if the watercraft is a sailing dinghy or other watercraft having a centerboard, the use instructions may include instructions for grasping the centerboard and/or using the centerboard as a foothold as part of a righting maneuver that also uses the one or more righting devices. As another example, if the watercraft has a beam of a suitable size and a gunwale of a graspable configuration when the watercraft is capsized and/or partially righted, the use instructions may include instructions for grasping the gunwale as part of a righting maneuver that also uses the one or more righting devices. In some instantiations, such watercraft-specific use instructions may include use instructions for both of these examples and/or other use instructions relating to one or more other features of the particular watercraft at issue. Some specific examples of steps that can be incorporated into use instructions provided with a kit of the present disclosure are described below.

In some aspects, the present disclosure is directed to watercraft that each include one or more righting devices made and/or installed in accordance with the present disclosure. Each of the one or more righting devices may be any of the righting devices disclosed herein or derivable therefrom by someone of ordinary skill in the art. Each of the watercraft may be any of the types specifically mentioned in this disclosure or any watercraft not specifically mentioned but that could benefit from having provided thereon or thereto one or more righting devices of the present disclosure.

With the foregoing in mind, following are some specific examples of the foregoing aspects, features, and functionalities. Those skilled in the art will readily understand that these examples are merely illustrative and are not intended to be limiting. Indeed, skilled artisans will be able to use teachings of this disclosure to embody features, aspects, and/or functionalities described herein in any of a wide variety of differing embodiments and instantiations without undue experimentation.

Referring now to the drawings, FIG. 1 illustrates example locations on a sample class of watercraft where a pair of righting aids may be provided to the watercraft. In this example, the watercraft is a sailing dinghy, and the three boat outlines 100(1) to 100(3) illustrating three differing sizes (small, medium, and large) typical of sailing dinghies 104(1) to 104(3). Specific dimensions, in feet, for the hull length and beam are illustrated for each of the three sizes. The boat outlines 100(1) to 100(3) may be considered to represent the longitudinal and transverse extents of the corresponding hull bottoms 108(1) to 108(3). In this example, each hull bottom 108(1) to 108(3) has a corresponding longitudinal centerline 112(1) to 112(3), and each sailing dinghy 104(1) to 104(3) has a corresponding centerboard 116(1) to 116(3).

With these specific hull bottoms 108(1) to 108(3), example locations 120(1)A, 120(1)B, 120(2)A, 120(2)B, 120(3)A, and 120(3)B are shown where righting devices (not shown) of the present disclosure may be provided, one righting device per location (i.e., two righting devices per sailing dinghy 104(1) to 104(3). In these examples, the locations 120(1)A, 120(1)B are on the small hull bottom 108(1), the locations 120(2)A, 120(2)B are on the medium hull bottom 108(2), and the locations 120(3)A, 120(3)B are on the large hull bottom 108(3). As can be readily seen, in this example, each pair of locations 120(1)A & 120(1)B, 120(2)A & 120(2)B, 120(3)A & 120(3)B on the corresponding hull bottoms 108(1) to 108(3) are located on opposite sides of the respective longitudinal centerline 112(1) to 112(3). As can also be seen in FIG. 1, in this example in which the sailing dinghies 104(1) to 104(3) have centerboards 116(1) to 116(3), the transverse centerlines 120(1)C, 120(2)C, and 120(3)C of corresponding locations 120(1)A, 120(1)B, 120(2)A, 120(2)B, 120(3)A, and 120(3)B are offset relative to the aft end 116(1)A, 116(2)A, and 116(3)A of the respective centerboards 116(1) to 116(3). As noted below, this allows a user to grasp onto and climb up each hull bottom 108(1) to 108(3) using both the righting devices (not shown, but located in corresponding respective ones of locations 120(1)A, 120(1)B, 120(2)A, 120(2)B, 120(3)A, and 120(3)B) and the corresponding centerboard 116(1) to 116(3).

The locations 120(1)A, 120(1)B, 120(2)A, 120(2)B, 120(3)A, and 120(3)B for locating righting devices of the present disclosure shown in FIG. 1 are merely exemplary for a particular type of watercraft in a specific size regime. Locations for watercraft of other types and/or sizes may differ from the illustrated locations 120(1)A, 120(1)B, 120(2)A, 120(2)B, 120(3)A, and 120(3)B. In some situations, considerations for determining the placement of locations for righting devices may include whether or not the watercraft has a centerboard or other structure that a user can grasp and/or stand on and the location of the center of gravity of the watercraft and/or the center of optimal righting force, along the length of the watercraft, alone or in combination with the impact of one or more sails being laid over into the water and creating additional resistance to righting the watercraft. It is noted that the present examples of FIG. 1 show two locations 120(1)A & 120(1)B, 120(2)A & 120(2)B, 120(3)A & 120(3)B for each hull bottom 108(1) to 108(3). However, depending on the circumstances, more or fewer locations and righting devices may be used.

For the sake of illustration, and not limitation, following are examples of procedures for righting a sailing dinghy in a conventional manner and righting the sailing dinghy using a pair of righting devices of the present disclosure. The two procedures for other watercraft may involve different steps depending on the features of the watercraft at issue.

Typical Conventional Small-Sailboat Capsize Recovery (Righting)

1. Boat capsizes and crew falls into water,
2. Uncleat main sheet and boom yang.
3. Rotate boat so mainsail is lying to leeward of the hull.
4. Helmsman moves to centerboard, climbs onto it, and while holding onto the gunwale leans back to bring the boat upright.
5. Crew climbs in over stern.

Figure 2A:
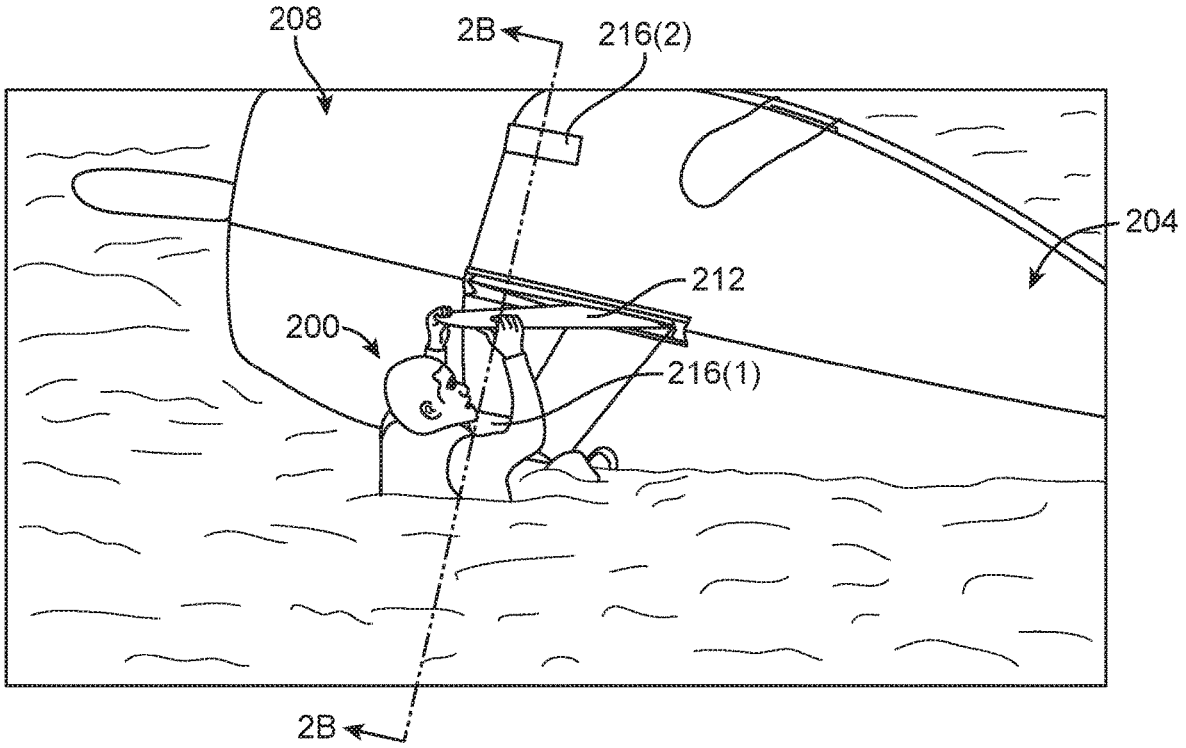
FIG. 2A is an elevational view of a capsized sailboat having a centerboard and two righting devices of the present disclosure.
Figure 2B:
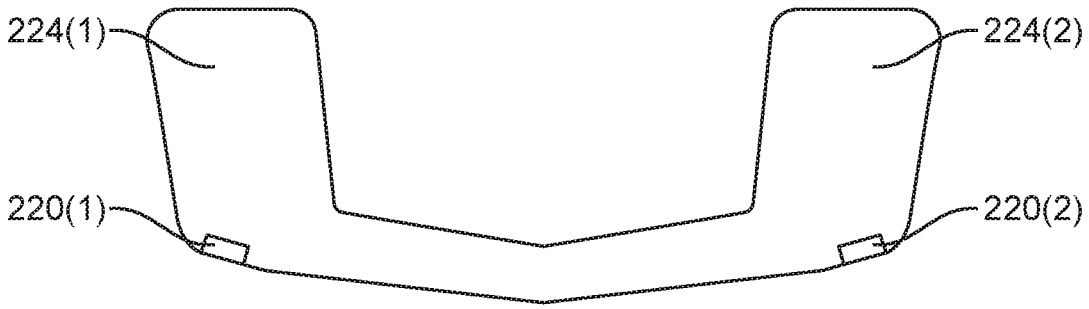
FIG. 2B is a rotated cross-sectional view of the capsized boat of FIG. 2A as taken along line 2B-2B of FIG. 2A, illustrating the righting devices as being of the recessed-receptacle type.

Example Sailboat Capsize Recovery (Righting) Using Righting Devices of the Present Disclosure 1. Boat capsizes and crew falls into water.
2. Uncleat main sheet and boom Yang.
3. Rotate boat so mainsail is lying to leeward of the hull.
4. Helmsman moves to centerboard, steps onto closest righting device, and while holding onto the gunwale leans back to bring the boat upright. For some helmsmen, the righting device can be used as a step for then stepping onto the centerboard in order to reach the gunwale. A second righting device closer to the gunwale may be used as a step to re-enter the boat as it rights, FIG. 2A illustrates a user, e.g., helmsman 200, starting to ascend the hull bottom 204 of a watercraft 208 using a centerboard 212. Locations 216(1) and 216(2) denote the locations for two righting devices 220(1) and 220(2), which, as seen in FIG. 2B, in this example are of the recessed-receptacle type that extend into floatation tanks 224(1) and 224(2) of the watercraft 208. While the righting devices 220(1) and 220(2) are shown as being of the recessed receptacle type, they may be of any type made in accordance with this disclosure,
5. Other crew climbs in over stern.

With the foregoing examples and generalities in mind, FIGS. 3A to 3E illustrate an example righting device 300 of a removable external type. In this example, the righting device 300 includes a base 304, a pair of foot/hand holds 308(1) and 308(2), and a fastening system 312 for securing the righting device to a hull bottom (not shown) of a watercraft. Non-limiting example locations for mounting righting device on a hull bottom are described above and shown in FIG. 2A. In this example, the base 304 is composed of one or more polymers, which can be selected to cause the righting device 300 to float at the surface of the body of water on which the watercraft is sailing should the righting device be dropped or otherwise end up in the water. In other embodiments, the base 304 may be made of one or more additional or other materials, such as metals, reinforced composites, and wood, among others. Fundamentally there are no limits on the material(s) of construction of the base 304 as long as it/they are suitably strong, stable, rigid, and durable, among other desirable qualities. In this example, the base 304 has a curved, here, spherical, shape that provides the righting device 300 with a relatively low drag coefficient so as to minimize the impact the righting device has on the watercraft's performance when moving through the water during normal operation (e.g., sailing). In other embodiments of external-type righting devices of the present disclosure, the corresponding bases may have any desired shape. From a functional standpoint, the base of an external-type righting device of this disclosure, such as the base 304 of the righting device 300, typically provides structure that holds the one or more foot/hand holds, such as foot/hand holds 308(1) and 308(2), in spaced relation to the hull bottom to which the righting device is attached and provides structure for interacting with the fastening system 312 so that the righting device is rigidly secured to the hull bottom.

Figure 3A:
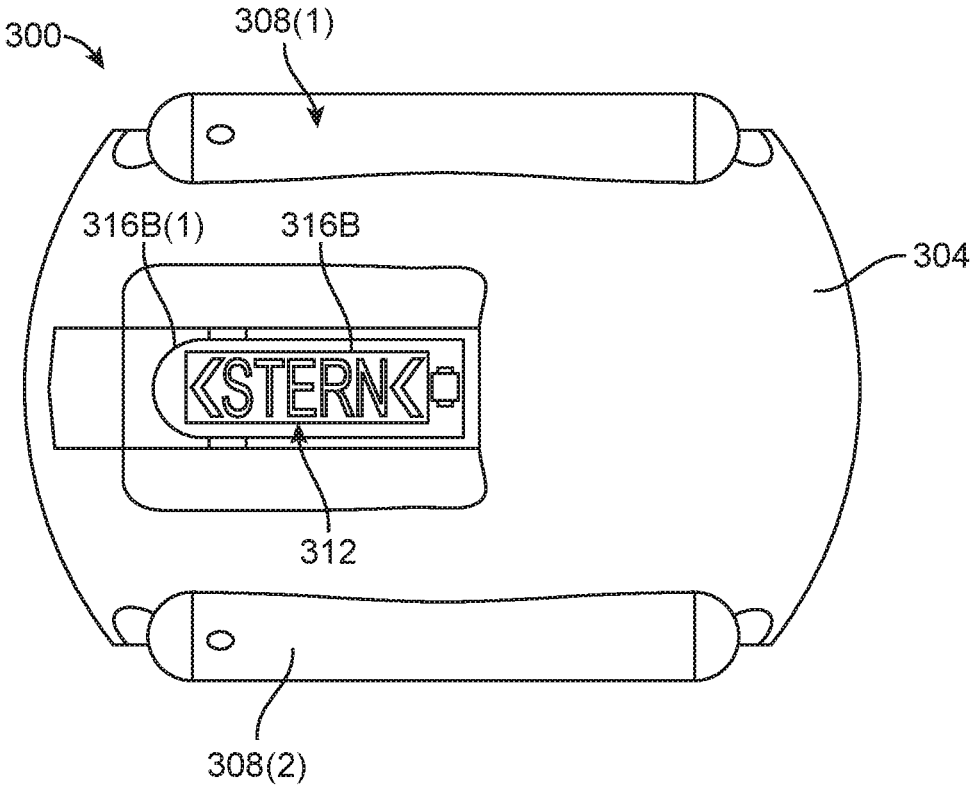
FIG. 3A is a front view of an example righting device of a removable external type.
Figure 3B:
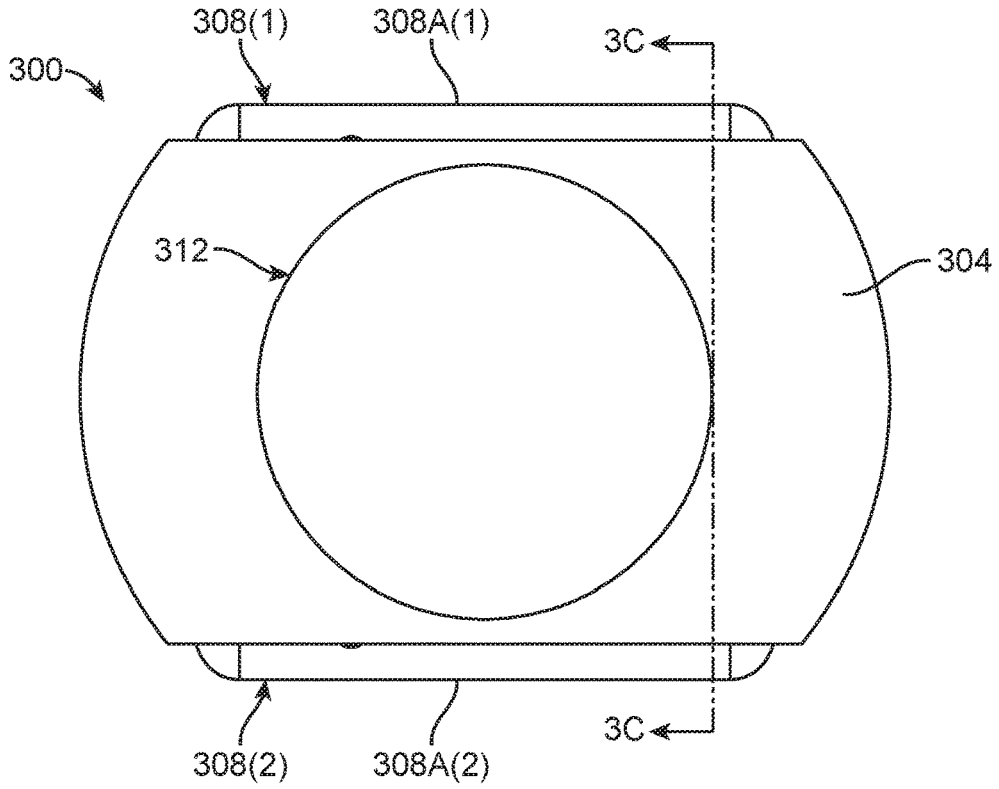
FIG. 3B is a rear view of the righting device of FIG. 3A.
Figure 3C:
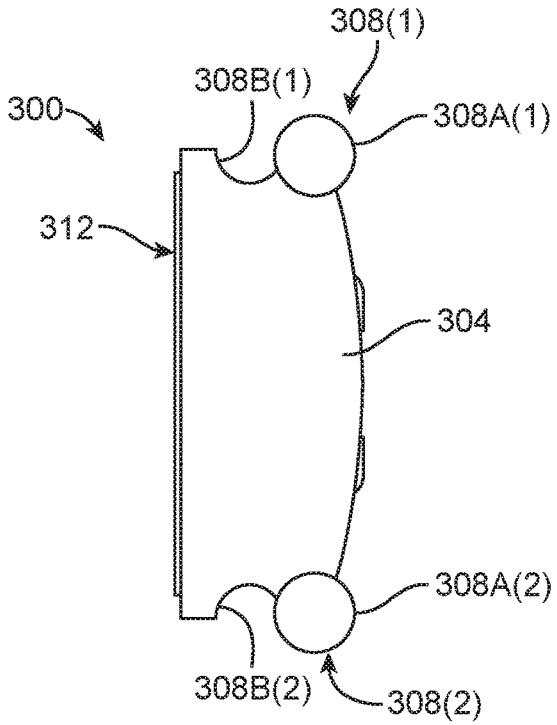
FIG. 3C is a cross-sectional view of the righting device of FIG. 3A as taken along line 3C-3C of FIG. 3B.

In this example, as shown on FIG. 3B, the pair of foot/hand holds 308(1) and 308(2) each include a protuberant portion 308A(1) and 308A(2) and, as shown on FIG. 3C, a corresponding groove 308B(1) and 308B(2) in the base 304. Here, the protuberant portions 308A(1) and 308A(2) are generally cylindrical in shape with hemispherical ends, and the corresponding grooves 308B(1) and 308B(2) are generally semicircular in transverse cross-sectional shape. In this embodiment, the foot/hand holds 308(1) and 308(2) are provided on opposing sides so that the righting device 300 provides the same functionality regardless of whether the watercraft capsizes to its starboard side or port side. For example, one can envision two instantiations of the righting device 300 deployed at the locations 216(1) and 216(2) shown in FIG. 2A. In FIG. 2A, the watercraft 208 is shown as capsized to its port side. However, it could also capsize to its starboard side. Consequently, bidirectional, for example, longitudinally symmetrical, righting devices, such as instantiations of the righting device 300 of FIGS. 3A to 3E, are desirable for such and similar deployments. That said, in other embodiments, a righting device need not be bidirectional and/or not include two foot/hand holds, like the foot/hand holds 308(1) and 308(2).

As mentioned above, in this example each of the foot/hand holds 308(1) and 308(2) comprises a corresponding protuberant portion 308A(1) and 308A(2) and a corresponding groove 308B(1) and 308B(2). It is noted, however, that other embodiments of a righting device of the present disclosure one or both of protuberant portion and corresponding groove of one, the other, or both of the foot/hand holds 308(1) and 308(2) need not be present. All that is needed is some structure in and/or on the base 304 that allows a user to grasp the righting device 300 firmly enough and/or stand on the righting device to effect a righting maneuver. In this example, each protuberant portion 308A(1) and 308A(2) is formed integrally and monolithically with the base 304, such as by molding. In some embodiments, each protuberant portion 308A(1) and 308A(2) may be made of a different material than the base 304, such as a material that is softer than the base and more slip resistant, such that the fabrication of the righting device 300 may include overmolding. In some embodiments, the protuberant portions 308A(1) and 308A(2) may be made separately from the base 304 and rigidly attached thereto using any suitable techniques, such as adhesive bonding, welding, brazing, mechanical fastening, etc., or any suitable combination thereof. In some embodiments, texturing, contouring, coating, or application of an additional layer on one or both of the protuberant portion 308A(1), 308A(2) and the groove 308B(1), 308B(2) of one, the other, or both of the foot/hand holds 308(1) and 308(2), or one or more portions thereof, to enhance gripability and/or anti-slip characteristics of the foot/hand holds.

Figure 3D:
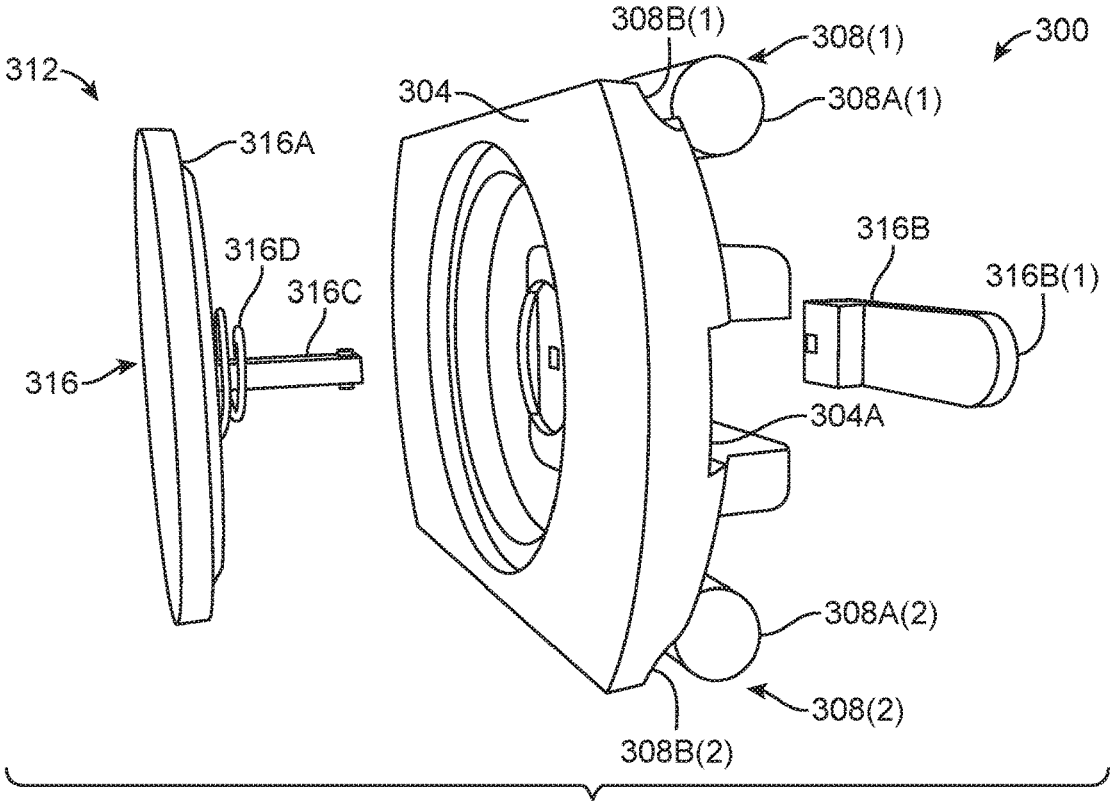
FIG. 3D is an exploded isometric side view of the righting device of FIG. 3A, showing features on the backside of the righting device.
Figure 3E:
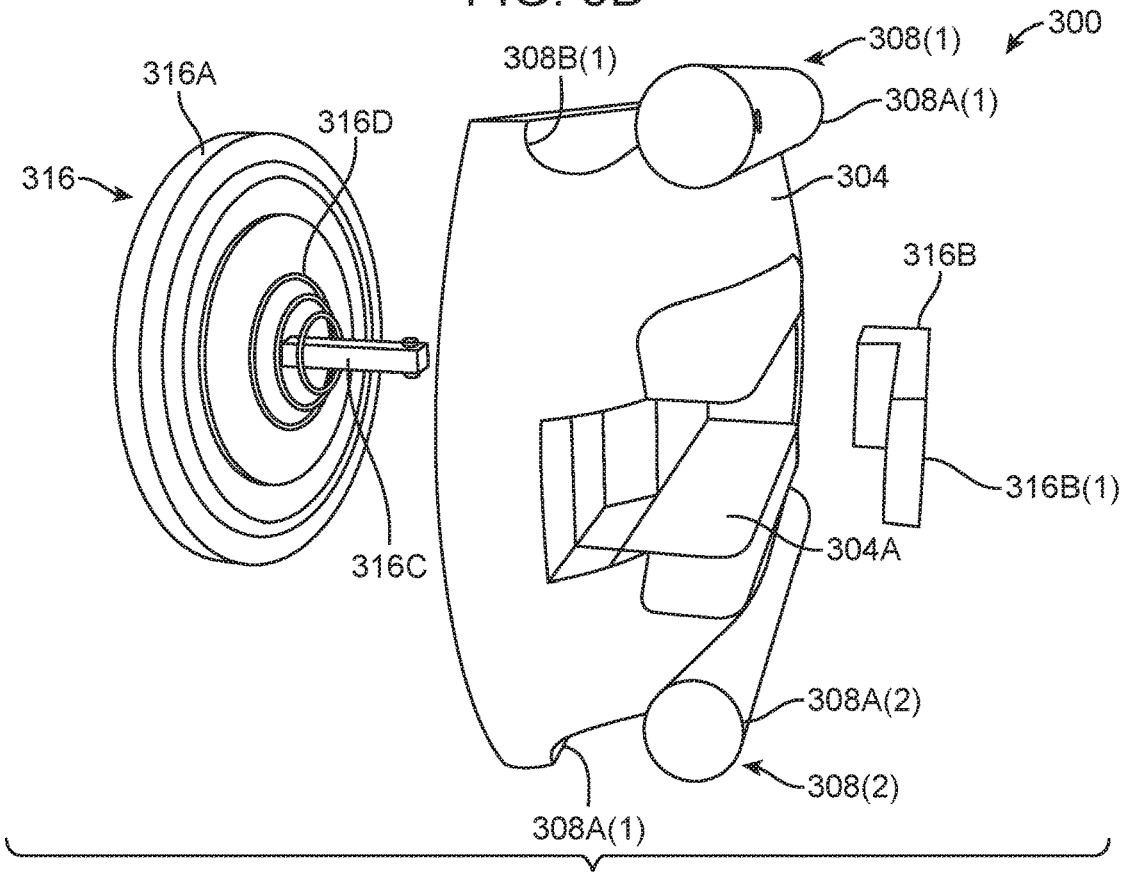
FIG. 3E is an exploded isometric side view of the righting device of FIG. 3A.

In this example, as shown in FIG. 3D, the fastening system 312 comprises a suction-cup mechanism 316 that allows a user to readily engage and remove the righting device 300 with and from a hull bottom (not shown). Hull bottoms typically have smooth surfaces that are readily amenable to firm engagement by suction cups, which makes the use of one or more suction cups a good choice for attaching the righting device 300 to a hull bottom for temporary use, since suction cups do not require the fastening system to penetrate the hull bottom. In this example, suction-cup mechanism 316 includes a suction cup 316A, an actuator, here a pivoting and cammed lever 316B, a linkage 316C, and a spring 316D. Suction-cup mechanisms suitable for use as suction-cup mechanism 316 are well known. However, for the sake of completeness, the particular suction-cup mechanism 316 shown is described briefly.

In this example, the lever 316B is located in a recess 304A within the base 304, and the righting device 300 is designed so that the free end 316B(1) of the lever is to be located aftward relative to the boat hull when the righting device is mounted thereon for use. In this example, this is evident from the marking "STERN" (FIG. 3A) and the arrows on the lever 316B itself. As shown in FIG. 3D, when the lever 316B is in the recess 304A, it is in its engaged position, with the suction cup 316A firmly holding the righting device on the hull bottom by vacuum. Having the free end 316B(1) facing the stern of the hull bottom, there is a much lower probability of the lever 316B being actuated unintentionally, such as getting snagged on debris in the water while the watercraft is moving forward.

To secure the righting device 300 to a hull bottom, with the righting device away from the boat hull a user pivots, if needed, the lever 316B from the position shown in FIG. 3D to an "open" position (not shown) in which the lever is normal relative to the front side of the righting device. This action, in conjunction with a biasing force of the spring 316D, causes the suction cup 316A to relax and flatten. While the suction cup 316A is in this relaxed state, the user engages the suction cup to the hull bottom in an appropriate location (see, e.g., FIG. 1) and in the proper orientation (here, with the free end 316B(1) of the lever 316B facing the stern of the watercraft), and then pivots the lever into the recess 304A in the base 304. This action pulls a central portion of the suction cup 316A, via the linkage 316C, outward away from the hull bottom to an "activated" position so as to induce a vacuum between the central portion of the suction cup and the hull bottom. The lever 316B is cammed so that it holds the suction cup 316A in this activated position until a user pivots the lever toward its open position, which releases the vacuum and allows a user to remove the righting device 300 from the hull bottom.

It is emphasized that suction-cup-based fastening system 312 is merely one example of a wide variety of fastening systems that can be used to secure an external-type righting device to a hull bottom. Other types of fastening systems suitable for fastening system 312 include, but are not limited to, mechanical-fastener-based systems, adhesive-based systems, latch-based systems, multi-component systems (e.g., having a permanent mounting plate and mating structure on the base of the righting device), or any suitable combination thereof, among others. In the context of the suction-cup mechanism 316 shown, many variations are possible, including the number of suction cups, the type of suction-cup-activation mechanism, and the size and location(s) of the suction cup(s) and any corresponding activation mechanism(s), among other things.

In one non-limiting example, the overall length of the righting device 300 (side-to-side distance in FIG. 3A) may be in a range from 7 inches to 10 inches (17.8 cm to 25.4 cm), and its overall height (top-to-bottom distance in FIG. 3A) may be in a range of 4 inches to 7 inches (10.2 cm to 17.8 cm), with the overall length of each foot/hand hold 308(1) and 308(2) being in a range of 5 inches to 8 inches (12.7 cm to 20.3 cm), and the overall thickness (side-to-side distance in FIG. 3C) of the righting device being in a range of 1.5 inches to 3 inches (3.8 cm to 7.6 cm). In some embodiments, the righting device 300 may be tethered to the watercraft (not shown) via a suitable tether (not shown), such as a flexible strap, braided line, etc., to prevent it from being lost should it become accidentally detached from the watercraft.

Figure 4A:
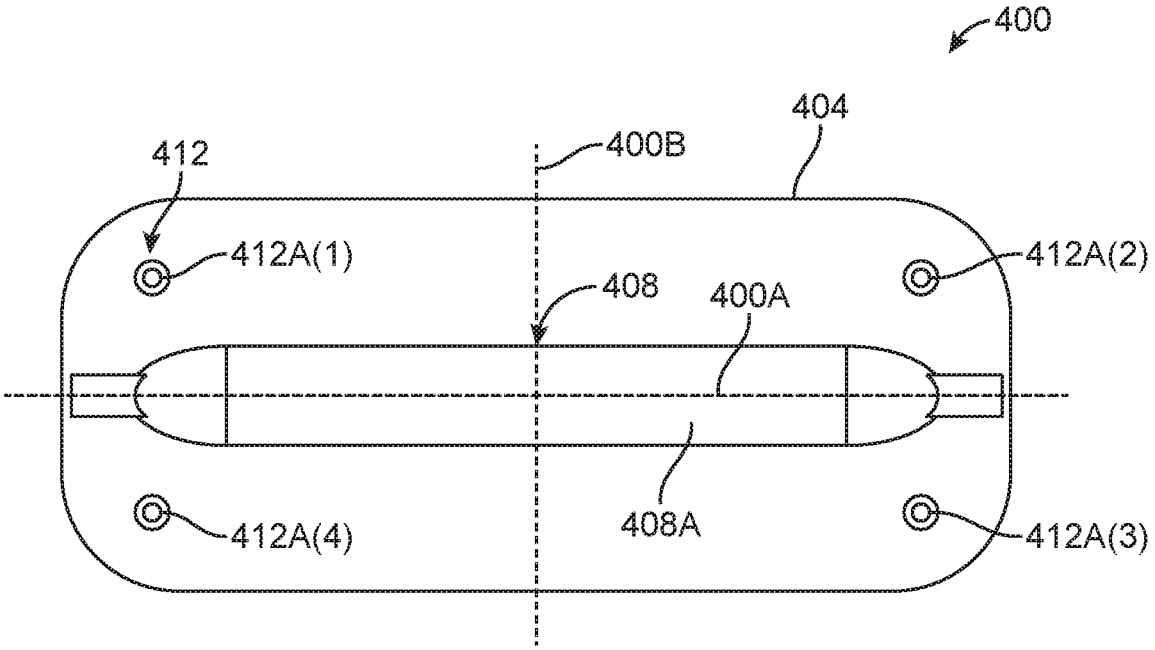
FIG. 4A is a front view of another example righting device of an external type.
Figure 4B:
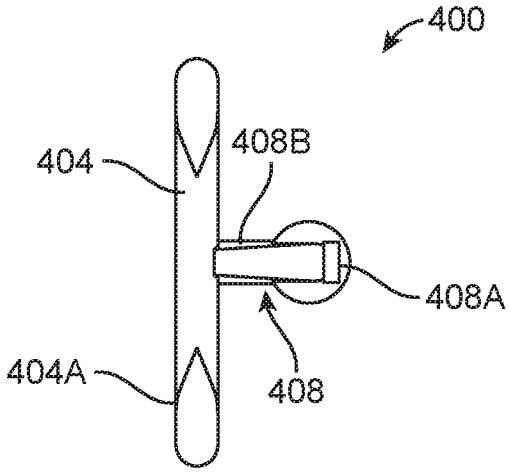
FIG. 4B is a side view of the righting device of FIG. 4A.

FIGS. 4A and 4B illustrate another example external righting device 400 made in accordance with the present disclosure. In this embodiment, the righting device includes a base 404, a single foot/hand hold 408 rigidly secured to the base so as to form a unitary rigid structure, and a fastening system 412, only part of which is illustrated. The righting device 400 is symmetrical about each of its longitudinal and transverse central axes, denoted 400A and 400B, respectively. This, in conjunction with it single foot/hand hold 408, make this righting device 400 quite simple in construction and in terms of form. In this example, the single-foot/hand hold 408 includes a generally cylindrical bulbous portion 408A located at the outward end of a support 408B. The bulbous portion 408A can function as both a foothold and a handgrip by virtue of its configuration and standoff location relative to the base 404. In some embodiments, the bulbous portion 408A may be provided with texturing, contouring, coating, or application of an additional layer so as to provide enhanced anti-slip characteristics and/or enhanced gripability. The shape of the bulbous portion 408A need not be largely cylindrical. Rather, it may be any suitable shape, such as an elongated ovoid shape or a prismatic shape having rounded corners, among others.

The righting device 400 may be made of any one or more suitable marine-grade materials, such as one or more marine-grade plastics and elastomers, among others. In some embodiments the base 404 and the foot/hand hold 408 may be unitary monolithic, such as being molded in a single mold (including overmolding), or they may be formed separately and rigidly attached to one another.

In this example, the fastening system 412 includes a set of through-holes, here, four through-holes 412A(1) to 412A(4) in the base 404 for receiving therethrough for mechanical fasteners (not shown), such as screws, bolts, or rivets. In some embodiments, such mechanical fasteners may be complemented with a marine-grade adhesive (not shown) applied between the back face 404A of the base 400 and the hull bottom (not shown) to which the righting device is attached. In this case, the adhesive would be part of the fastening system 412. In some embodiments, the mechanical fasteners and through-holes 412A(1) to 412A(4) may be eliminated. In such embodiments, the fastening system 412 may include just adhesive (not shown) or some other fastening system, such as one or more suction cups, among others.

In one non-limiting example, the overall length of the righting device 400 (side-to-side distance in FIG. 4A) may be in a range from 9 inches to 14 inches (22.9 cm to 35.6 cm), and its overall height (top-to-bottom distance in FIG. 4A) may be in a range of 4 inches to 7 inches (10.2 cm to 17.8 cm), with the overall length of the foot/hand hold 408 being in a range of 7 inches to 11 inches (10.2 cm to 27.9 cm), and the overall outstanding distance from a hull bottom (side-to-side distance in FIG. 4B) of the righting device being in a range of 2 inches to 5 inches (5.1 cm to 12.7 cm). In some embodiments, the righting device 400 may be tethered to the watercraft (not shown) via a suitable tether (not shown), such as a flexible strap, braided line, etc., to prevent it from being lost should it become accidentally detached from the watercraft.

Figure 5:
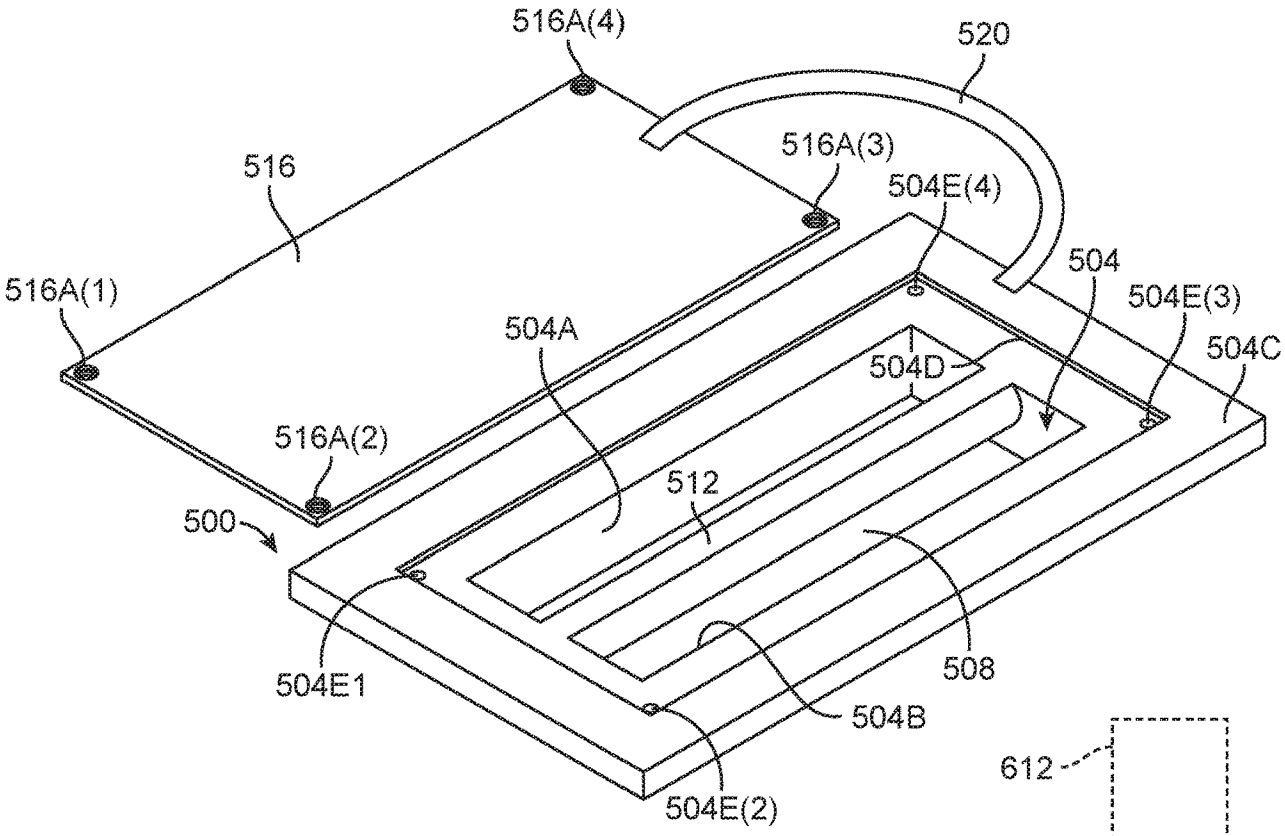
FIG. 5 is an isometric view of a righting device of a recessed-receptacle type.

Whereas FIGS. 3A through 4B illustrate examples of external righting devices 300 and 400 that extend outwardly from a hull bottom, FIG. 5 illustrates an example recessed righting device 500 that is recessed into the hull bottom relative to the outer surface of the hull bottom. A recessed righting device of the present disclosure, such as the righting device 500 of FIG. 5, can provide a watercraft with a permanent solution to providing righting aids while also minimizing the impact of the righting device on watercraft performance. Another benefit of a recessed righting device of the present disclosure, such as the righting device 500 of FIG. 5, over an external righting device of this disclosure, such as righting devices of FIGS. 3A and 4A, respectively, is that it is far less susceptible to damage, disengagement, and/or damaging the hull bottom because it does not project outwardly from the hull bottom. This can be particularly beneficial to applications wherein the watercraft is used in shallow water where the hull bottom is likely to contact the bottom of the body of water, the watercraft is trailered, the watercraft is intentionally beached during use, and/or the watercraft is frequently handled out of the water, among others.

Referring to FIG. 5, in this embodiment, the righting device 500 includes a receptacle 504 containing one or more recesses (one recess 508 in this example) that provide(s) space for receiving a portion of a user's foot (not shown) and/or a portion of a user's hand (not shown) so that the righting device 500 can function as a foot/hand hold. As an example implementation, the righting device 500 of FIG. 5 may be used for each of the recessed-type righting devices 220(1) and 220(2) of FIG. 2B. Referring again to FIG. 5, in this embodiment the righting device 500 includes a bar 512 that can function both as a handgrip and a step (e.g., rung), as needed, so as to provide the righting device with its foot/hand hold ability(ies). The bar 512 may be provided with texturing, contouring, coating, or application of an additional layer so as to provide enhanced anti-slip characteristics and/or enhanced gripability. The shape of the bar 512 need not be largely cylindrical. Rather, it may be any suitable shape, such as an elongated ovoid shape or a prismatic shape having rounded corners, among others.

In some embodiments, the bar 512 may be eliminated and, correspondingly, the height, H, of the recess 508 may reduced as well, if desired. In embodiments not including the bar 512, one or both of the edges 504A and 504B may each be provided with a suitable structure to provide the righting device with foot/hand holdability. For example, the edges 504A and 504B may each be configured to include a protuberant portion and/or a groove, for example, in a manner similar to each of the protuberant portions 308A(1), 308A(2) and the grooves 308B(1), 308B(2) of FIG. 3A, so as to provide the necessary foot/hand holds.

Referring again to FIG. 5, in the embodiment shown the receptacle 504 is made as a distinct structure separate from the hull bottom (not shown) in which it will be installed. In other embodiments, the receptacle may be formed integrally with a hull bottom during the manufacturing of the hull bottom. In the context of a fiberglass hull bottom, this integral formation may be effected using a "negative" structure in the hull-bottom mold that defines the recess 508. Then, the fiberglass and resin is formed around the negative structure, which is then removed when the hull bottom is released from the mold.

As mentioned above, in its depicted standalone form, the receptacle 504 may be installed as a retrofitting to an existing hull bottom (not shown) or it may be integrated into a new hull bottom during manufacturing. Manners of installing the receptacle 504 into an existing hull bottom include adhesively bonding and/or mechanically fastening the receptacle in a suitable opening cut into the hull bottom. Those skilled in the art will understand how to retrofit the receptacle into any hull bottom according to the particular hull construction at issue. If the receptacle 504 is incorporated into a hull bottom during construction of the hull bottom, it may be positioned in a manner similar to the negative structure noted above, but instead of just serving as a forming structure, the fiberglass and resin layup process would attach the receptacle to the hull bottom. The receptacle 504 and bar 512, if provided, may be made of any one or more suitable materials, such as marine-grade plastics, composites, woods, and metals, among others. In any installation scenario, ideally surface 504C would be flush with the outer surface (not shown) of the surrounding portion of the hull bottom.

The embodiment shown in FIG. 5 includes a closure 516 that can be used to cover the recess 508 when the functionality of the righting device 500 is not needed. In this example, closure 516 is secured in a closure receiver 504D of the receptacle 504 using a set of four screws (not shown) corresponding to the four through-holes 516A(1) to 516A(4) on the closure and the four threaded holes 504E(1) to 504E(4) on the receptacle. In this example, the closure 516 is intended for use when the righting device 500 is not needed for an extended period, such as when the corresponding watercraft (not shown) is being used only with experienced and able sailors. This is so because the screws would be an impediment to removing the closure 516 easily during a capsizing event. In this example, the righting device 500 also includes one or more tethers (one tether 520 shown) each extending between and secured to the closure 516 and the receptacle 504 to ensure that the closure is not lost. Examples of suitable tethers that can be used for the tether 520 include, but are not limited to, a section of nylon line, a plastic strip, a hinge, among others. In addition, or alternatively, the closure 516 may be constructed so that it floats when disengaged from the receptacle 504.

In other embodiments, the closure 516 may be provided with one or more quick-release features (not shown) in addition to or in lieu of the threaded fastener features so that a user can quickly temporarily remove the closure during a capsizing event. If threaded fasteners are also used, they can be used only when the righting device 500 will not be needed during a capsizing event. Example quick-release features include, but are not limited to, a friction fit, an interference fit with one or more retractable bodies (e.g., tab(s), pin(s), latch(es), etc.), a pivoting latch, and a sliding latch, among others.

Figure 6:
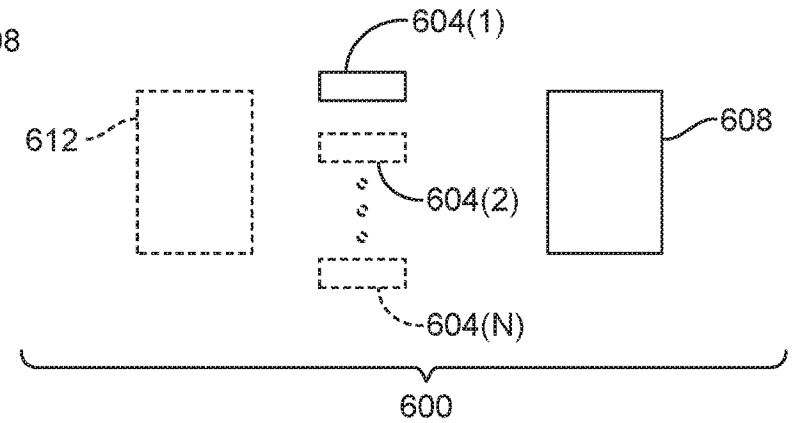
FIG. 6 is a high-level block diagram illustrating an example kit containing at least one righting device, installation instructions, and/or use instructions.

FIG. 6 illustrates an example kit 600 of the present disclosure that includes one or more righting device(s) 604(1) to 604(N) and either installation instructions 608 for the righting device(s) or use instructions 612 for the righting device(s), or both installation and use instructions. Each righting device 604(1) to 604(N) may be any righting device made in accordance with the present disclosure, such as, for example, the righting devices 220(1) and 220(2) of FIG. 2B, the righting device 300 of FIG. 3A, the righting device 400 of FIG. 4A, or the righting device 500 of FIG. 5, any modified version thereof, or any righting device described herein. A particular watercraft may require a specific number of righting devices, such as two, based on the size and/or configuration of the watercraft. In some cases, the kit 600 may include the specific number of righting device(s) 604(1) to 604(N) for a watercraft. In some cases, the kit 600 may include only a single righting device 604(1), for example, if it is a replacement righting device. In some cases, the kit 600 may include more righting device(s) 604(1) to 604(N) than needed for any given watercraft. For example, a manufacturer, sailing club, or other organization may buy the righting devices 604(1) to 604(N) in bulk for two or more watercraft.

The installation instructions 608 include instructions for installing the righting device(s) 604(1) to 604(N) in the kit 600. In some instantiations, the installation instructions 608 will include instructions on where to locate and/or how to orient the righting device(s) 604(1) to 604(N) on a hull bottom (not shown). In some instantiations, the instructions for locating the righting device(s) 604(1) to 604(N) will be specific for a particular watercraft or class of watercraft or both, or two or more watercrafts or two or more classes of watercrafts. In some instantiations, the installation instructions 608 will include instructions for securing the righting device(s) 604(1) to 604(N) in the kit 600 to or in the hull bottom, depending on the type of the righting device(s). Example instructions for securing the righting device(s) 604(1) to 604(N) to or in the hull bottom include instructions for deploying the relevant fastening system(s) of the righting devices and instructions for installing the righting device(s) in a hull bottom, the latter especially in the case of recessed-type righting devices.

As mentioned above, the installation instructions 608 may be of any suitable type, such as written, graphical, audio, video, and live demonstration, or any suitable combination thereof. As also mentioned above, the installation instructions 608 need not be physically present in the kit 600 with the righting device(s) 604(1) to 604(N). For example, the installation instructions 608 may be accessible from another location, such as webserver (not shown) remote from the righting device(s) 604(1) to 604(N) of the kit. In some instantiations, the installation instructions 608 are contained in and/or on packaging (not shown) containing the righting device(s) 604(1) to 604(N). In some instantiations, the installation instructions 608 are on a remote webserver, and the kit includes, in accompaniment to the righting device(s) 604(1) to 604(N), an Internet uniform resource locator (URL) (not shown) for the instructions on the remote web server. Those skilled in the art will readily understand the many ways that the installation instructions 608 may be provided to a user or otherwise be made available to the user.

The kit 600 may optionally include the use instructions 612, which describe and/or demonstrate how a user should use the righting device(s) 604(1) to 604(N) in the kit when righting the capsized watercraft on which the righting device (s) have been installed. In one example, the use instructions 612 may include instructions conveying the steps discussed above in connection with FIGS. 2A and 2B. The use instructions 612 may differ for differing types of watercraft and/or differing types of righting devices (e.g., external versus recessed, with or without closures, differing foot/hand hold configurations, etc.). Similar to the installation instructions 608, the use instructions 612 may be incorporated into the kit 600 in any suitable manner, such as in physical accompaniment to the righting device(s) 604(1) to 604(N) and/or accessible from a remote webserver to name just a couple.

The foregoing has been a detailed description of illustrative embodiments of the present disclosure. It is noted that in the present specification and claims appended hereto, conjunctive language such as is used in the phrases "at least one of X, Y and Z" and "one or more of X, Y, and Z," unless specifically stated or indicated otherwise, shall be taken to mean that each item in the conjunctive list can be present in any number exclusive of every other item in the list or in any number in combination with any or all other item(s) in the conjunctive list, each of which may also be present in any number. Applying this general rule, the conjunctive phrases in the foregoing examples in which the conjunctive list consists of X, Y, and Z shall each encompass: one or more of X; one or more of Y; one or more of Z; one or more of X and one or more of Y; one or more of Y and one or more of Z; one or more of X and one or more of Z; and one or more of X, one or more of Y and one or more of Z.

Various modifications and additions can be made without departing from the spirit and scope of this disclosure. Features of each of the various embodiments described above may be combined with features of other described embodiments as appropriate in order to provide a multiplicity of feature combinations in associated new embodiments. Furthermore, while the foregoing describes a number of separate embodiments, what has been described herein is merely illustrative of the application of the principles of the present invention. Additionally, although particular methods herein may be illustrated and/or described as being performed in a specific order, the ordering is highly variable within ordinary skill to achieve aspects of the present disclosure. Accordingly, this description is meant to be taken only by way of example, and not to otherwise limit the scope of this disclosure.

Exemplary embodiments have been disclosed above and illustrated in the accompanying drawings. It will be understood by those skilled in the art that various changes, omissions and additions may be made to that which is specifically disclosed herein without departing from the spirit and scope of the present invention.

What is claimed is:

1. A kit for assisting a user in righting a watercraft when the watercraft is capsized, the watercraft including a hull bottom, the kit comprising:

a righting device that includes:

a base for confronting the hull bottom;

a fastening system for securing the righting device to the hull bottom; and at least one foot/hand hold fixedly secured to the base, the at least one foot/hand hold spaced from the hull bottom so as to allow the user to grasp the at least one foot/hand hold when the watercraft is capsized; and installation instructions for instructing an installer on installing the righting device on the hull bottom, the installation instructions including:

instructions for locating the righting device on the hull bottom so as to allow a user to stand on the at least one foot/hand hold to aid in righting the watercraft; and instructions for deploying the fastening system to secure the righting device to the hull bottom;

wherein the righting device includes a pair of foot/hand holds secured to the base on opposing sides of the base.

2. The kit of claim 1, wherein the hull bottom has an exterior surface where the righting device is located, and the fastening system is a temporary fastening system that breaks the exterior surface of the hull bottom when deployed to secure the righting device to the hull bottom.

3. The kit of claim 2, wherein the fastening system comprises a suction cup.

4. The kit of claim 3, wherein the fastening system further comprises a lever for activating the suction cup and the instructions for deploying the fastening system includes instructions for operating the lever to activate the suction cup against the hull bottom.

5. A kit for assisting a user in righting a watercraft when the watercraft is capsized, the watercraft including a hull bottom, the kit comprising:

a righting device that includes:

a base for confronting the hull bottom;

a fastening system for securing the righting device to the hull bottom; and at least one foot/hand hold fixedly secured to the base, the at least one foot/hand hold spaced from the hull bottom so as to allow the user to grasp the at least one foot/hand hold when the watercraft is capsized; and installation instructions for instructing an installer on installing the righting device on the hull bottom, the installation instructions including:

instructions for locating the righting device on the hull bottom so as to allow a user to stand on the at least one foot/hand hold to aid in righting the watercraft; and instructions for deploying the fastening system to secure the righting device to the hull bottom;

wherein:

the hull bottom has a longitudinal centerline and the kit comprises multiple ones of the righting device, wherein the instructions include instructions for deploying at least two of the multiple ones of the righting device on laterally opposite sides of the centerline; and the watercraft includes a centerboard, and the instructions include instructions for locating the at least two of the multiple ones of the righting device relative to the centerboard.

6. The kit of claim 5, wherein the instructions further include instructions for righting the watercraft using the at least two of the multiple ones of the righting device and the centerboard.

7. The kit of claim 5, wherein the instructions include instructions for locating the at least two of the multiple ones of the righting device aftward of the centerboard but in close-enough proximity that the user can use the centerboard in conjunction with the at least two of the multiple ones of the righting device to right the watercraft when capsized.

8. A righting device for assisting a user with righting a watercraft when the watercraft is capsized, the watercraft having a hull bottom, the righting device comprising:

a base;

a fastening system coupled to the base and provided to secure the righting device to the hull bottom; and a pair of foot/hand holds on opposite sides of the base and rigidly secured to the base so as to be spaced from the hull bottom when the righting device is secured to the hull bottom, each of the pair of foot/hand holds including a step region having one or more anti-slip features to inhibit slipping when the user is engaging the step region to right the watercraft when capsized;

wherein the fastening system includes a suction cup.

9. The righting device of claim 8, wherein the at least one foot/hand hold further includes a handgrip to allow the user to grip the at least one foot/hand hold with at least one hand when using the righting device to right the watercraft when capsized.

10. The righting device of claim 8, wherein the foot/hand holds are unitary monolithic with the base.

11. The righting device of claim 8, wherein the suction cup is a lever-activated suction cup.

12. The righting device of claim 11, wherein the fastening system is integrated into the base.

13. The righting device of claim 8, wherein the hull bottom has an exterior surface where the righting device is located, and the fastening system is a temporary fastening system that breaks the exterior surface of the hull bottom when deployed to secure the righting device to the hull bottom.

14. A watercraft, comprising:

a hull having a bottom and a longitudinal centerline;

a first righting device located on the bottom of the hull in a first location laterally offset relative to the longitudinal centerline; and a centerboard, wherein the first location of the first righting device is longitudinally, relative to the longitudinal centerline, offset from the centerboard.

15. The watercraft of claim 14, wherein the first location is longitudinally offset aftward of the centerboard by a distance that allows the user to grasp and/or stand on the centerboard when using the first righting device to right the capsized boat.

16. The watercraft of claim 14, further comprising a righting hold device located on the bottom of the hull in a second location laterally offset relative to the longitudinal centerline in a direction opposite the first location of the first righting device.

17. The watercraft of claim 14, wherein the first location is longitudinally offset aftward of the centerboard by a distance that allows the user to grasp and/or stand on the centerboard when using the first and second righting devices to right the capsized boat.

18. The watercraft of claim 14, wherein the first righting device is provided by a recessed foot/hand hold receptacle in the bottom of the hull.

19. The watercraft of claim 18, further comprising a removable cover that covers the recessed foot/hand hold receptacle when the recessed foot/hand hold receptacle is not in use.

20. The watercraft of claim 14, wherein the first righting device is provided by a first foot/hand hold device secured to the bottom of the hull and comprising:

a base;

a fastening system coupled to the base and provided to secure the righting device to the hull bottom; and at least one foot/hand hold rigidly secured to the base so as to be spaced from the hull bottom when the righting device is secured to the hull bottom, the at least one foot/hand hold including a step region having one or more anti-slip features to inhibit slipping when the user is engaging the step region to right the watercraft when capsized.

21. The watercraft of claim 20, wherein the at least one foot/hand hold further includes a handgrip to allow the user to grip the at least one foot/hand hold with at least one hand when using the righting device to right the watercraft when capsized.

* * * * *